US008291876B2

(12) United States Patent
Patrick

(10) Patent No.: US 8,291,876 B2
(45) Date of Patent: Oct. 23, 2012

(54) CAMSHAFT VARIABLE TIMING LIMITING DEVICES, METHODS OF ASSEMBLY, AND USES THEREOF

(75) Inventor: Matthew Patrick, Oakland, TN (US)

(73) Assignee: Comptetition Cams Inc., Memphis, TN (US)

( * ) Notice: Subject to any disclaimer, the term of this patent is extended or adjusted under 35 U.S.C. 154(b) by 815 days.

(21) Appl. No.: 12/314,930

(22) Filed: Dec. 18, 2008

(65) Prior Publication Data

US 2009/0188452 A1 Jul. 30, 2009

Related U.S. Application Data

(60) Provisional application No. 61/006,724, filed on Jan. 29, 2008.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 4,577,592 | A | 3/1986 | Bosch et al. | |
| 5,002,023 | A | 3/1991 | Butterfield et al. | |
| 5,033,327 | A | 7/1991 | Lichti et al. | |
| 5,046,460 | A | 9/1991 | Butterfield et al. | |
| 5,107,804 | A | 4/1992 | Becker et al. | |
| 5,172,659 | A | 12/1992 | Butterfield et al. | |
| 5,207,192 | A | 5/1993 | Smith | |
| 5,361,735 | A | 11/1994 | Butterfield et al. | |
| 6,453,859 | B1 | 9/2002 | Smith et al. | |
| 6,477,999 | B1 | 11/2002 | Markley | |
| 6,971,354 | B1 | 12/2005 | Smith et al. | |
| 7,124,722 | B2 | 10/2006 | Smith | |
| 2006/0000435 | A1 * | 1/2006 | Aust et al. | 123/90.17 |
| 2007/0245991 | A1 * | 10/2007 | Weber | 123/90.17 |

* cited by examiner

*Primary Examiner* — Zelalem Eshete
(74) *Attorney, Agent, or Firm* — Arent Fox LLP

(57) ABSTRACT

A variable timing limiting device for mounting to a camshaft variable timing mechanism includes a flange having a central opening and a travel limiter extending from the flange, wherein the camshaft variable timing mechanism has a hub and a sprocket having a recessed portion, the travel limiter being matably receivable in the recessed portion of the sprocket. In another aspect of the disclosure, a variable timing limiting device for a camshaft variable timing mechanism includes a free floating travel limiter inserted into a chamber portion of the camshaft variable timing mechanism. In another aspect of the disclosure, a camshaft variable timing mechanism for securing to a camshaft includes a hub, a vane lobe extending from the hub, a sprocket portion having a recess configured to receive an end of the vane lobe, the vane lobe being capable of travel within the recess, and a variable timing limiting device.

18 Claims, 14 Drawing Sheets

CAMSHAFT VARIABLE TIMING LIMITING DEVICES, METHODS OF ASSEMBLY, AND USES THEREOF

CROSS-REFERENCE TO RELATED APPLICATION

This application claims priority to U.S. Provisional Patent Application No. 61/006,724 titled "CAMSHAFT VARIABLE TIMING LIMITING DEVICES, METHODS OF ASSEMBLY, AND USES THEREOF" filed Jan. 29, 2008.

BACKGROUND OF THE INVENTION

1. Field of the Invention

Aspects of the present invention relate to the field of camshaft variable timing for combustion engine applications and methods of assembly and use thereof, and in particular to methods, systems, and devices for hydraulically and otherwise selectively limiting variable adjustment of camshaft timing.

2. Background of the Technology

There is an unmet need in the prior art for limiting camshaft advance and/or retard for, among other things, racing and/or other high performance applications.

SUMMARY OF THE INVENTION

Aspects of the present invention provide features for limiting advance and/or retard travel of camshaft variable timing systems for, among other purposes, use in racing and/or other high performance applications.

Aspects of the present invention enhance the performance of camshaft variable timing operation in, among other things, high performance engine applications (e.g., for internal combustion engines modified for drag race and/or other high performance applications) by limiting the advance (and/or retard) of related art camshaft variable timing systems. In some aspects, mechanical stops are provided that are insertable into recesses in a portion of an existing camshaft variable timing mechanism, so as to stop and/or limit the relative rotational travel of the hub to the driven (e.g., sprocket) portion of the camshaft variable timing mechanism.

Some exemplary applications of aspects of the present invention involve limiting rotational travel of the hub to the sprocket or other driven portion of the camshaft variable timing mechanism to about 20° for high performance applications, for example. One feature for such limiting rotational travel as needed for such applications, in accordance with aspects of the present invention, may involve reprogramming the control system (e.g., electronic control module) for the camshaft variable timing system, such that the hub (rotational motion of which is typically monitored as a part of the control) is limited in its travel to a selected range.

Alternative to or in conjunction with modifying the control system for the camshaft variable timing system, some aspects of the present invention include the installation of a set of one or more travel limiters that interact with one or more corresponding vane lobes of the camshaft variable timing mechanism, so as to stop and/or limit travel of the hub in a single rotational direction.

The set of travel limiters of some aspects of the present invention may, for example, when positioned relative to the chambers of the camshaft variable timing mechanism, be designed so as to limit travel of the hub relative to the driven (e.g., sprocket) portion of the camshaft variable timing mechanism only in a single rotational direction (e.g., only to limit advance or retard). In other aspects of the present invention, a first subset of the set of travel limiters (e.g., three of five travel limiters) may be positioned so as to limit such relative rotational travel in a first direction (e.g., to limit camshaft advance), and a second subset of the set of travel limiters (e.g., two of the five travel limiters) may be positioned so as to limit relative rotational travel in a second direction (e.g., to limit camshaft retard).

In yet other aspects of the present invention, a device may provide one or more pairs of travel limiters interoperable with one or more corresponding pairs of chamber portions of the camshaft variable timing mechanism. Via use of one or more pairs of such travel limiters, relative rotational travel in both a first direction (e.g., to limit camshaft advance) and a second direction (e.g., to limit camshaft retard) may likewise be obtained.

Additional advantages and novel features of aspects of the invention will be set forth in part in the description that follows, and in part will become more apparent to those skilled in the art upon examination of the following or upon learning by practice of the invention.

DETAILED DESCRIPTION

Figure 1:
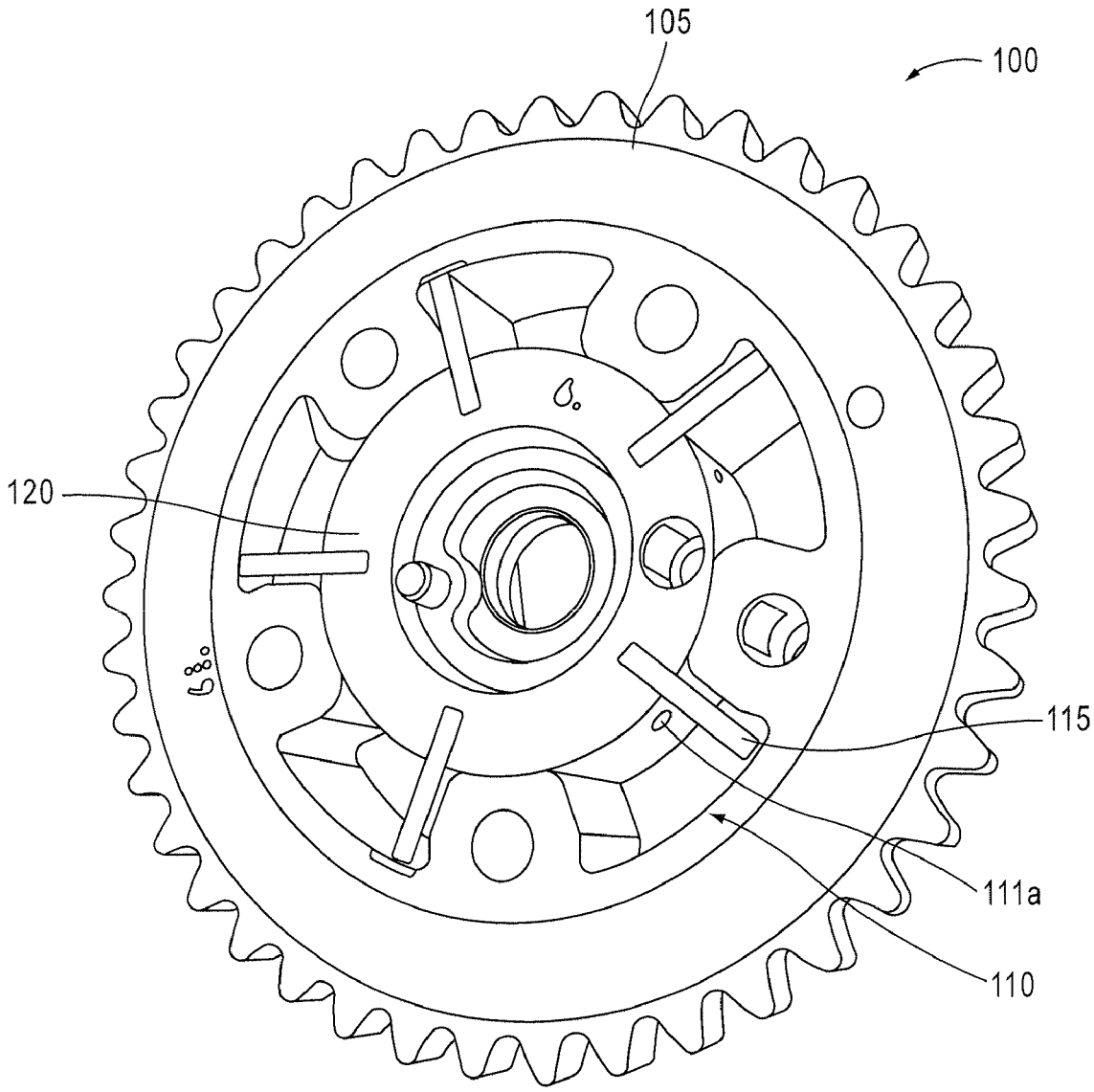
FIGS. 1-6 show various views of a portion of an exemplary related art unmodified camshaft variable timing system, usable in accordance with aspects of the present invention.
Figure 2:
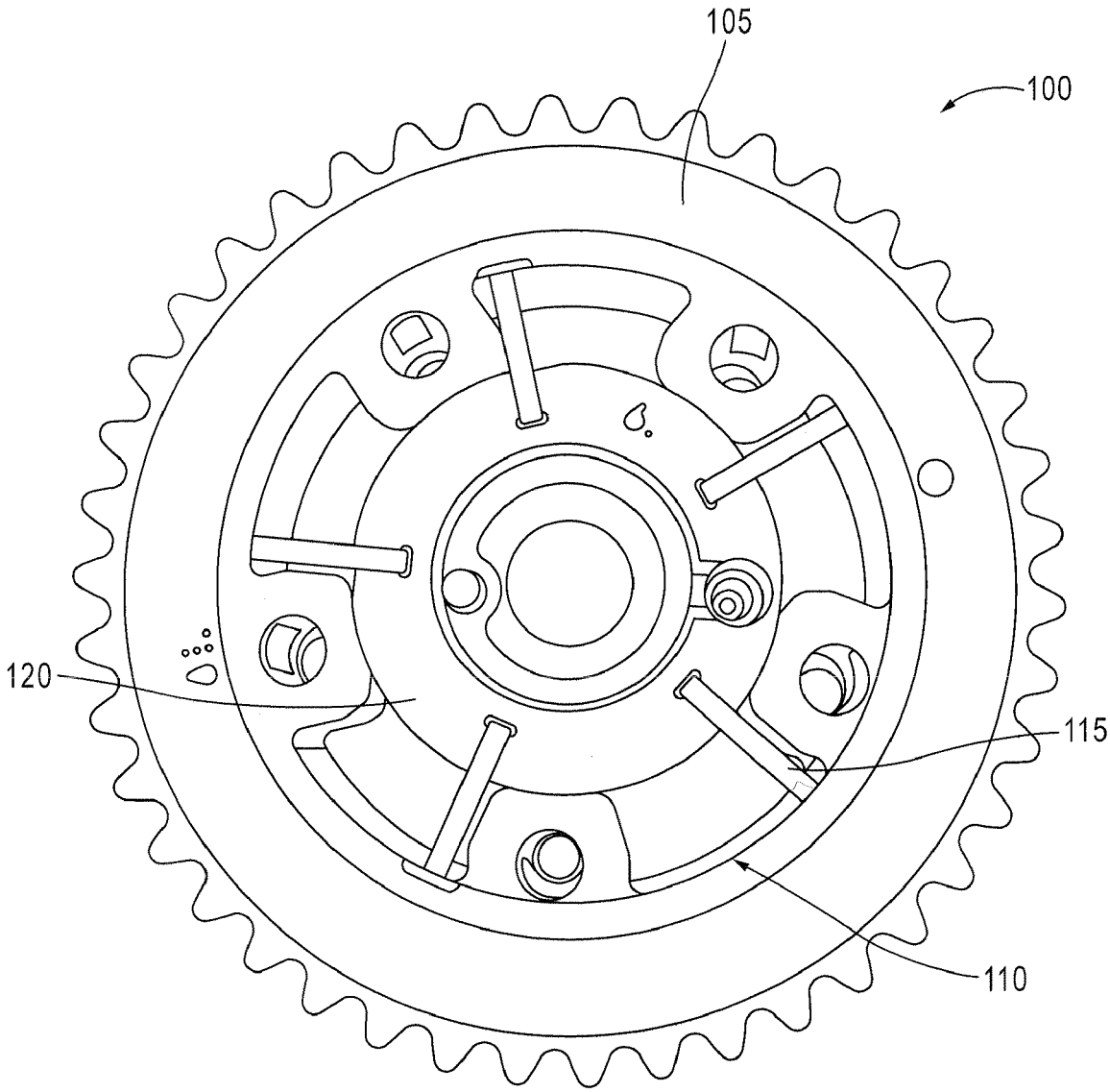
Figure 3:
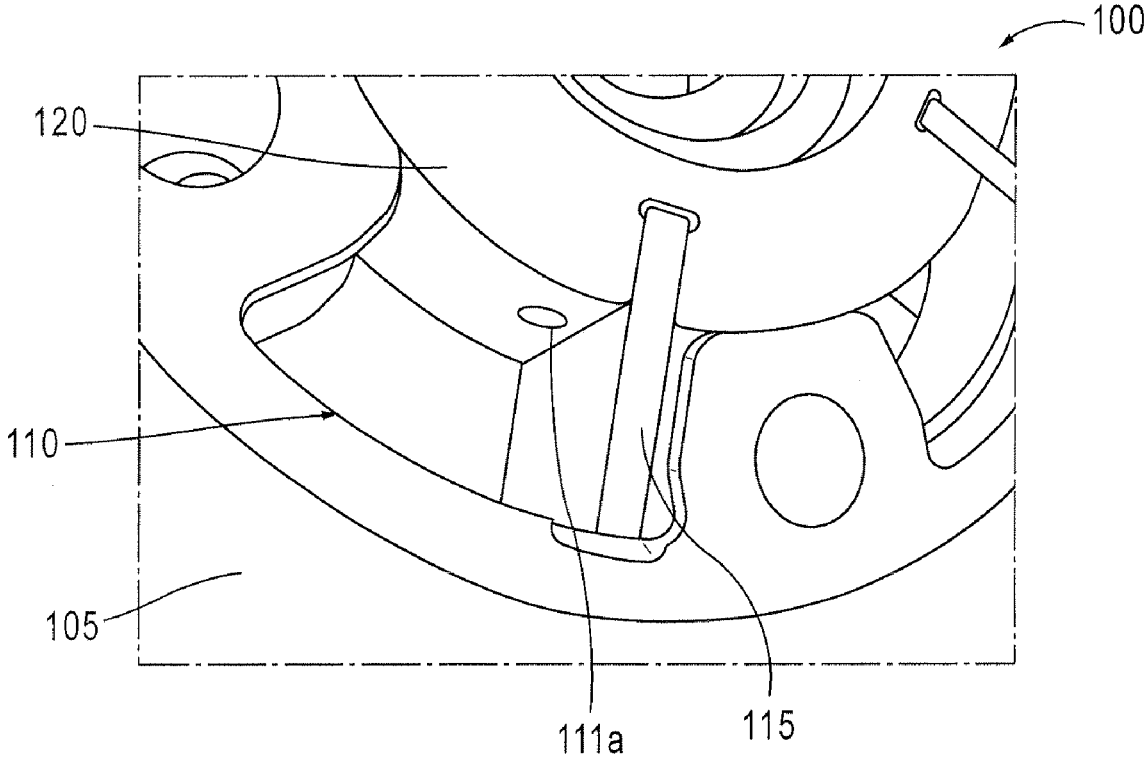
Figure 4:
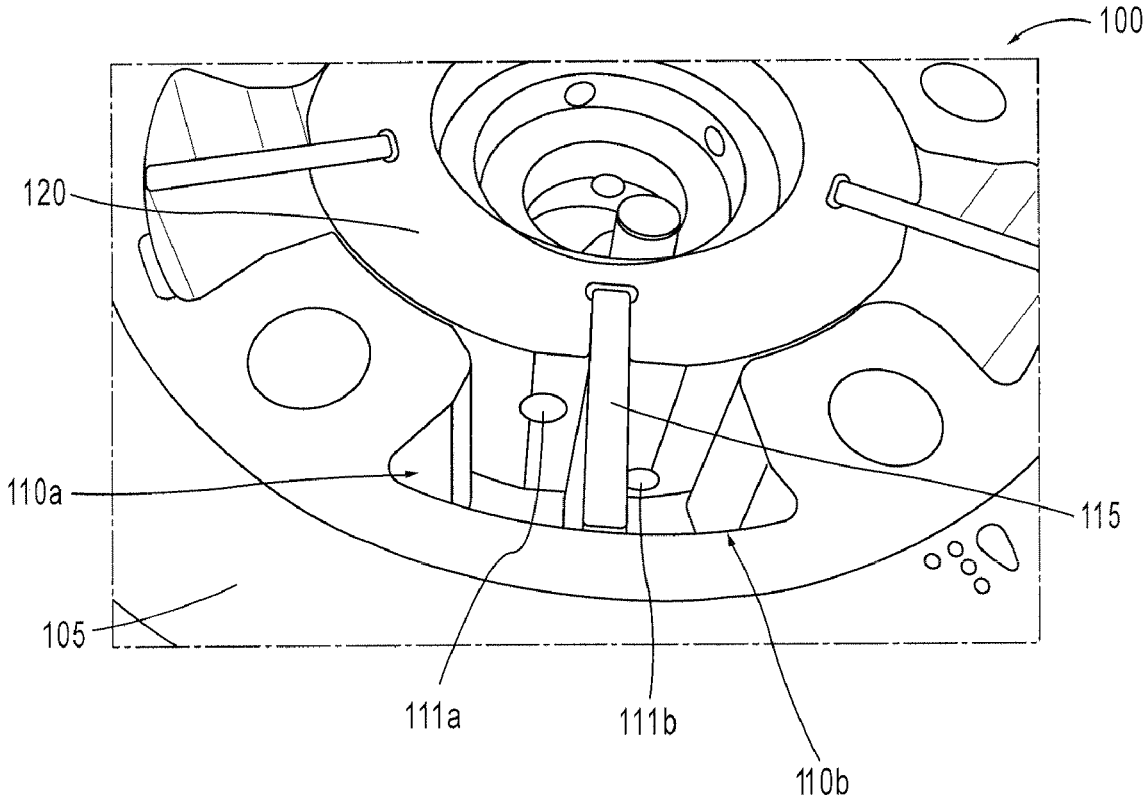
Figure 5:
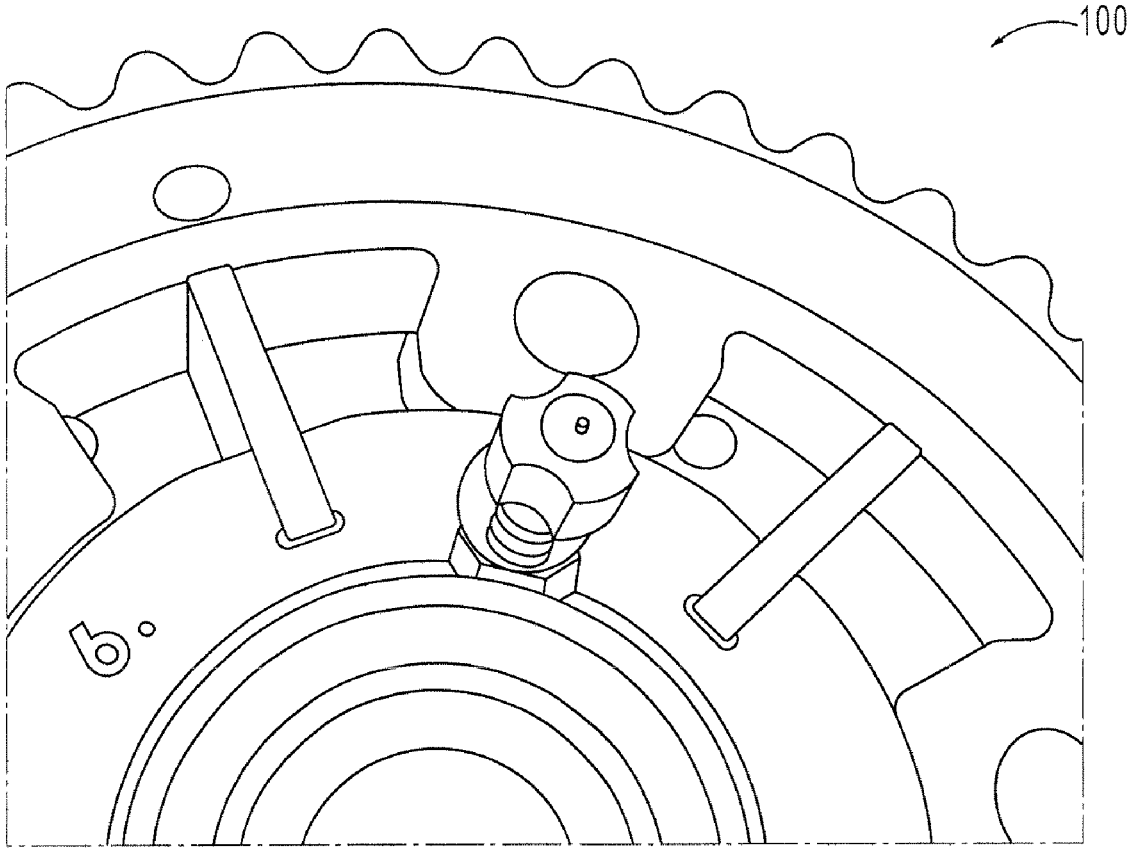
Figure 6:
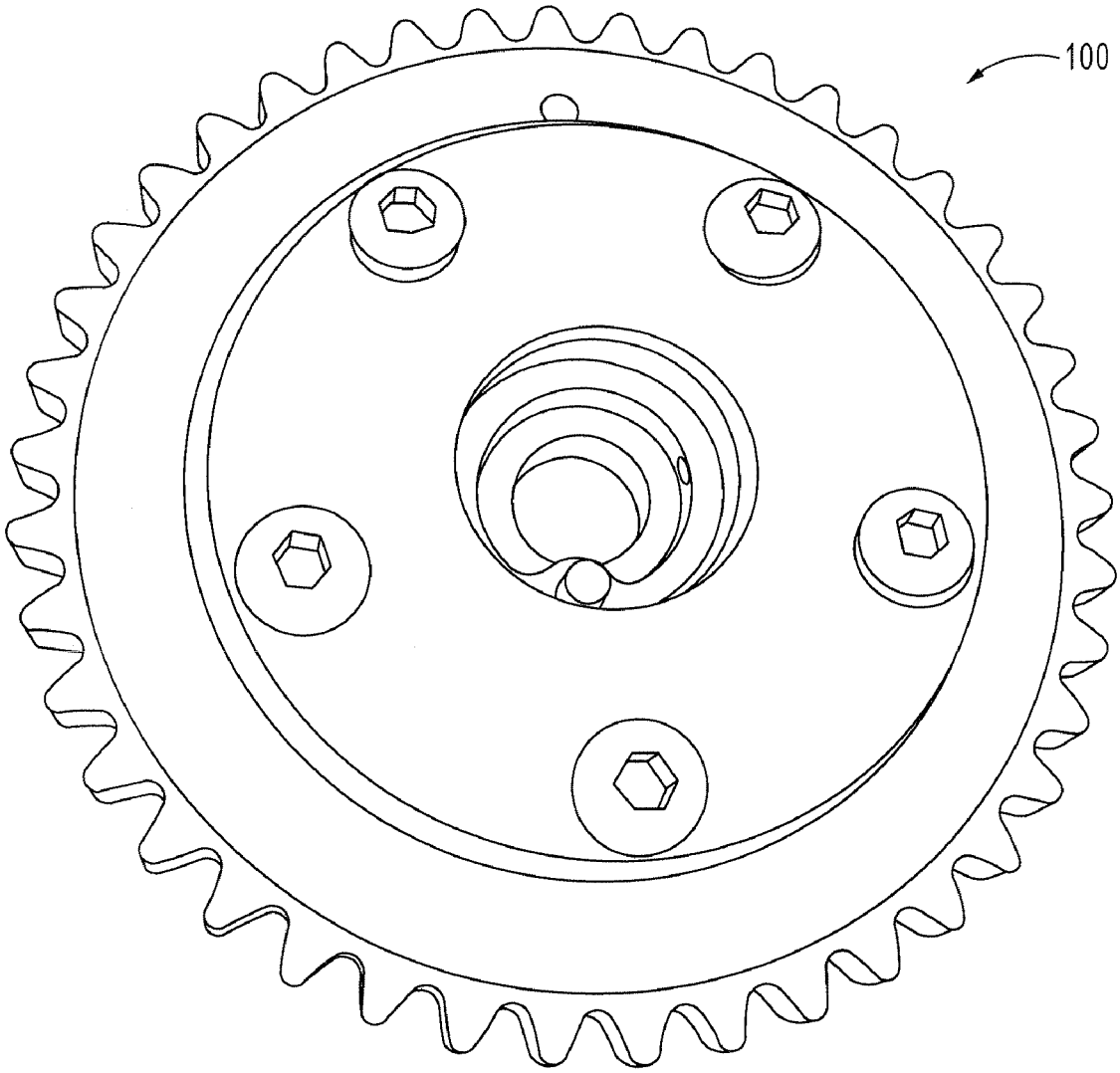

Exemplary related art camshaft variable timing systems, methods, features, and operation are shown and described in one or more of U.S. Pat. No. 4,577,592 to Bosch, et al., U.S. Pat. No. 5,002,023 to Butterfield, et al., U.S. Pat. No. 5,033,327 to Lichti, et al., U.S. Pat. No. 5,046,460 to Butterfield, et al., U.S. Pat. No. 5,107,804 to Becker, et al., U.S. Pat. No. 5,172,659 to Butterfield, et al., U.S. Pat. No. 5,207,192 to Smith, U.S. Pat. No. 5,361,735 to Butterfield, et al., U.S. Pat. No. 6,453,859 to Smith, et al., U.S. Pat. No. 6,477,999 to Markley, U.S. Pat. No. 6,971,354 to Smith, et al., and U.S. Pat. No. 7,124,722 to Smith, the entirety of each of which is incorporated herein by reference.

FIGS. 1-6 show various views of a portion of an exemplary related art unmodified camshaft variable timing system, usable in accordance with aspects of the present invention. This portion 100 of the system (this example, as well as other similarly operating examples of this portion of such systems of the related art, also interchangeably referred to herein as the "camshaft variable timing mechanism"), which is secured, for example, via hub 120 to one end of a camshaft for an internal combustion engine, includes a sprocket portion 105, recesses 110 (forming two subchambers 110*a*, 110*b*, as more clearly shown in FIG. 4) for receiving hydraulic fluid (e.g., engine oil) for causing rotational motion of vane lobes 115 within the recesses 110, via hydraulic inlets 111*a*, 111*b* (as more clearly shown in FIG. 4). Vane lobes 115 in turn extend from hub 120 or otherwise operably interact with hub 120. The recesses 110 are closed around the lobes 115 by transversely extending annular plates (not shown) which are fixed relative to the lobes 115. The recesses and, in particular, each subchamber 110*a*, 110*b* are thus capable of sustaining hydraulic pressure.

In operation, variable hydraulic pressure delivered via hydraulic inlet 111*a* relative to that delivered via hydraulic inlet 111*b* causes rotation of hub 120 relative to sprocket portion 105, thereby varying the timing between rotation of the camshaft (and, hence, operation of the cams), relative to a driven rotational velocity of the sprocket 105. As a result, suitable timing "advance," for example, can be effectuated for the camshaft, such as at varying revolutions per minute (RPM) operation of an internal combustion engine in which the camshaft operates.

Figure 7:
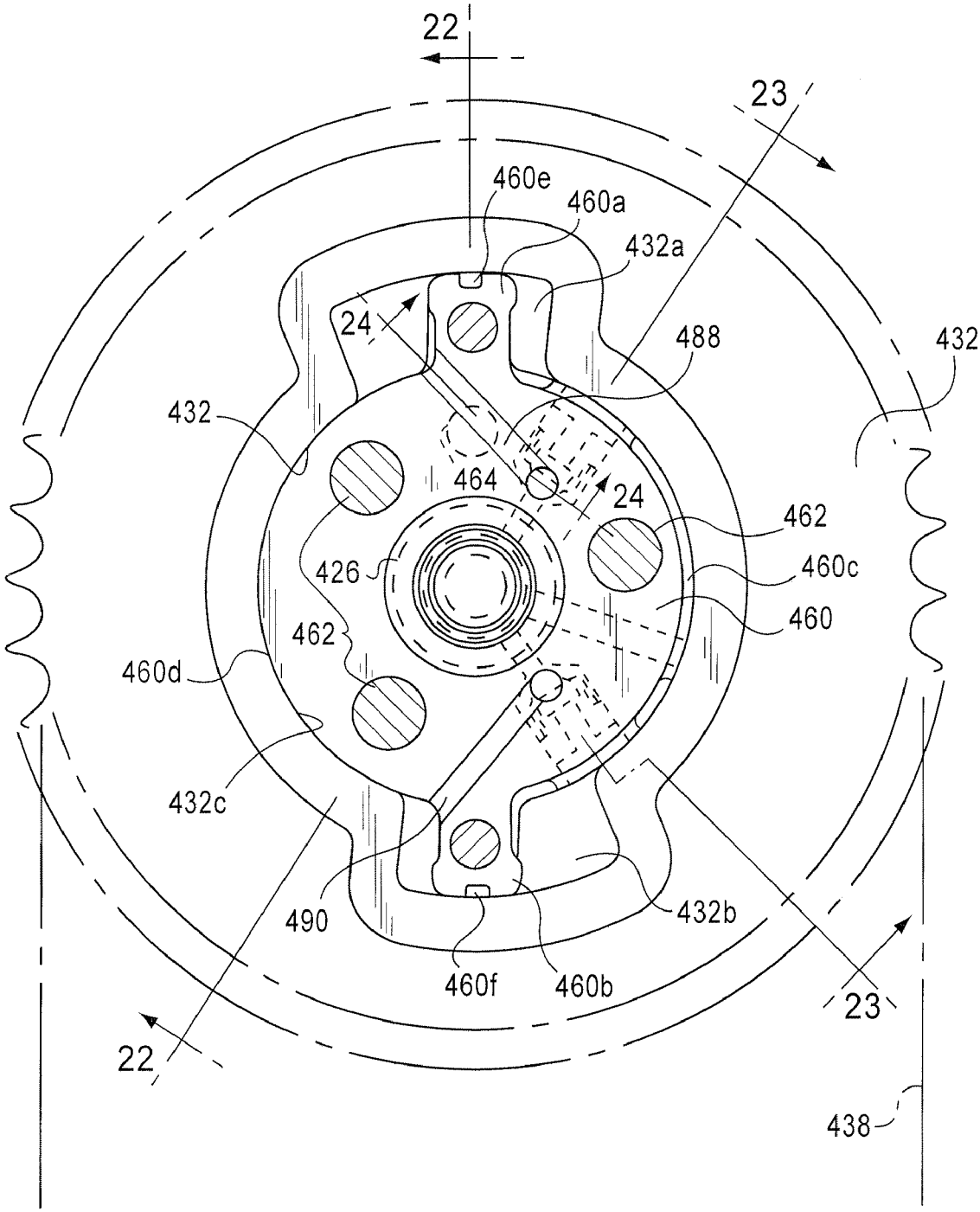
FIGS. 7 and 8 present further information on exemplary operation of a hydraulically operated camshaft variable timing system, usable in accordance with aspects of the present invention.
Figure 8:
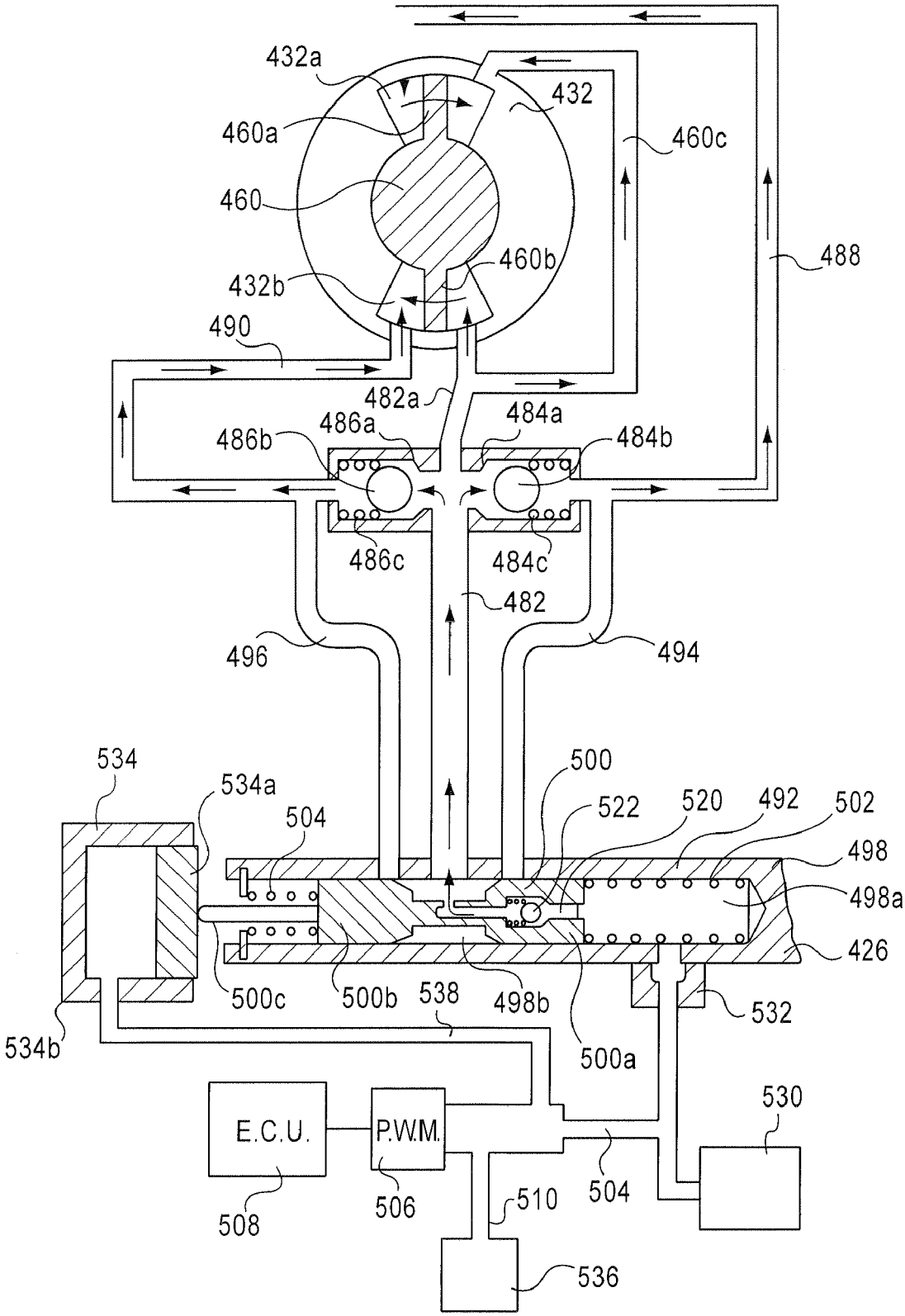

FIGS. 7 and 8, which partially reproduce FIGS. 21 and 29 from U.S. Pat. No. 5,107,804, and the text corresponding thereto in U.S. Pat. No. 5,107,804, present further information on exemplary operation of a hydraulically operated camshaft variable timing system, usable in accordance with aspects of the present invention.

Operation of the above exemplary unmodified camshaft variable timing system of the related art typically works suitably for most combustion engine applications, so long as the internal combustion engine is operated as designed for normal operation. However, in racing and/or other high performance applications (e.g., extreme high engine RPM applications), among other conditions, less than optimal performance can result due, for example, to the inability of the system to operate appropriately at operational extremes of the internal combustion engine.

Aspects of the present invention enhance the performance of camshaft variable timing operation in, among other things, extreme high RPM and/or racing engine applications (e.g., for internal combustion engines modified for drag race and/or other racing applications) by limiting the advance (and/or retard) of such existing art camshaft variable timing systems. In some aspects, one or more mechanical stops (also interchangeably referred to herein as "travel limiters") are provided that are insertable into recesses in a portion of an existing camshaft variable timing mechanism of such camshaft variable timing systems, so as to stoppably limit the rotational travel of the rotational hub of the existing camshaft variable timing mechanism, relative to the sprocket or other driven portion of such mechanism.

One example of less than optimal performance of related art camshaft variable timing systems involves the magnitude of rotational travel freedom of the unmodified camshaft advance, which is typically around 60°. Especially in high performance applications (e.g., extreme high RPM and/or racing applications), among other things, control of clearance between the intake and exhaust valves relative to the position of the piston, as well as control of the overlap time between the intake and exhaust valves (e.g., the period of time when both valves may be open simultaneously under certain circumstances), during high speed operation of the internal combustion engine can be severely restricted with unmodified camshaft variable timing systems.

Some exemplary applications of aspects of the present invention involve limiting rotational travel of the hub relative to the sprocket or other driven portion of the camshaft variable timing mechanism to about 20° for high performance applications, for example. One feature for limiting such rotational travel as needed for such applications, in accordance with aspects of the present invention, may involve reprogramming the control system (e.g., electronic control module) for the camshaft variable timing system, such that the hub (rotational motion of which is typically monitored as a part of the positional control) of the camshaft variable timing mechanism is limited to a selected range of rotational travel relative to the spoke or other driven portion of the mechanism.

Such reprogramming may be necessary because operation of the camshaft typically varies as function of inputs of position of the hub position relative to the sprocket or other driven portion, along with received engine operational conditions, among other factors. Generally, hydraulic fluid pressure then is variably communicated as appropriate for operational conditions to each of the two subchambers of each recess in the camshaft variable timing system, and the relative pressures in the two subchambers varied in response to the input information, so as to control advance, for example.

In some control systems, the range of travel and input control conditions for such relative positioning may be reset to selected conditions, so as to limit rotational motion to a smaller range than for normal operation. However, depending on operational conditions, reprogramming may be insufficient to control rotational motion appropriately for needs in accordance with aspects of the present invention. For example, under extreme high RPM, high performance, and/or high load conditions, the hydraulic and control systems may not be able to operate responsively enough to prevent motion outside the range of advance (or retard) that is reprogrammed, and/or catastrophic or other improper operation may therefore occur (e.g., valve interference with piston motion). Examples of such extreme high RPM, high performance, and/or high load condition situations include rapid deceleration events in drag races, when, for example, clutch engagement occurs in certain circumstances, where engine speed can thereby rapidly change from 7000 to 4500 RPM. In addition, in some control systems, for example, at startup, a test of rotational travel of the hub relative to the sprocket or other driven portion may occur, and if the originally preprogrammed range of motion remains preset, and that range is not achieved, the camshaft variable timing system may be rendered inoperable by the control system.

Therefore, alternative to or in conjunction with modifying the control system for the camshaft variable timing system with which aspects of the present invention operate, some aspects of the present invention include the installation of one or more sets of blocking mechanisms that interact with one or more vane lobes of the camshaft control mechanism so as to stop and/or limit travel of the hub in one or more rotational directions relative to the spoke or other driven portion.

FIGS. 9A-9D present perspective, two opposite end, and side views, respectively, of an exemplary device in accordance with aspects of the present invention for limiting travel via the five vane lobes of the camshaft variable timing mechanism of FIGS. 1-6. As shown in FIGS. 9A-9D, the device 900 may include a flange portion 902 having a central opening 903, one or more securing features 904 (e.g., openings for receiving an attachment screw or bolt), and one or more travel limiters 905*a*-905*e* forming a set of limiters extending from the flange portion 902.

In exemplary operation, the device 900 of FIGS. 9A-9D is securably (e.g., by screw, bolt, adhesive, or other attachment mechanism and/or method) positioned relative to the camshaft variable timing mechanism 100 of FIGS. 1-6, such that the travel limiters 905*a*-905*e* of FIGS. 9A-9D are inserted so as to reside in the recesses 110 of the mechanism 100 and thereby limit travel of the hub 120 relative to the sprocket or other driven portion 105 of FIG. 1-6 in at least one rotational direction.

Figure 10:
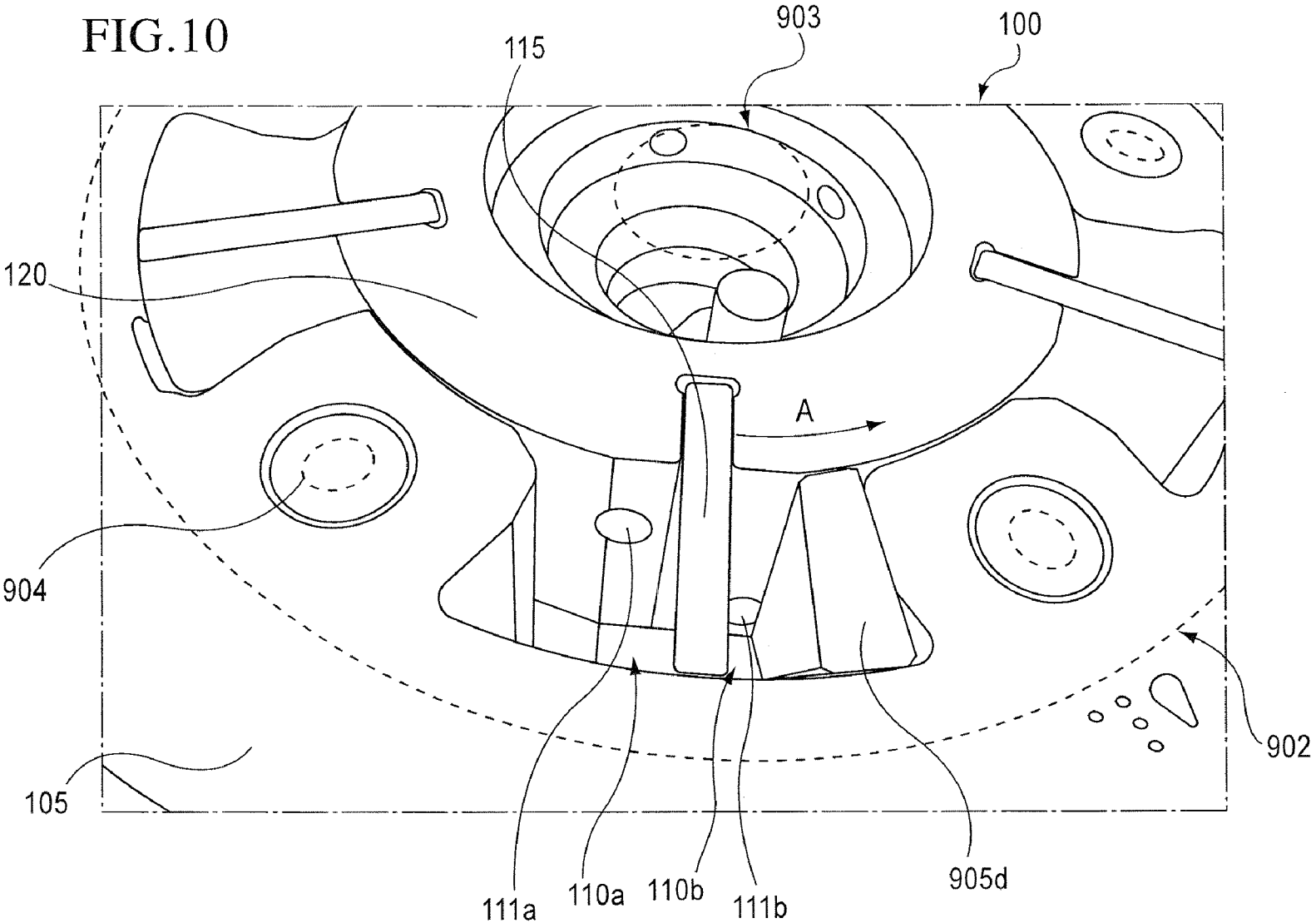
FIG. 10 shows a representative partial see-through view of the positioning of an example travel limiter within a sub-chamber of a camshaft variable timing mechanism, in accordance with one aspect of the present invention.

FIG. 10 shows a representative partial see-through view of the positioning of an example travel limiter 905*d* within a subchamber 110*b* of a camshaft variable timing mechanism 100, in accordance with one aspect of the present invention. The travel limiter 905*d* may be free to "float" or move within the subchamber 110*b* relative to the hub and/or sprocket. Annular plates (not shown) may be provided that extend transversely and enclose the recesses 110. Motion of the vane lobe 115 in the direction A shown in FIG. 10 is thereby limited or stopped by the presence of the travel limiter 905*d* within the subchamber 110*b* when the vane lobe 115 contacts the travel limiter 905*d*. As a result of this stopping or limitation of the travel of the vane lobe 115, rotational motion of the hub 120 relative to the sprocket or other driven portion 105 is thereby limited to less than the travel possible absent the presence of the travel limiter 905*d*. Note that, in some aspects of the present invention, the positioning of the travel limiter 905*d* is such that the limiter 905*d* does not substantially interfere with operation of the hydraulic inlet 111*b*.

Although operation of aspects of the present invention illustrated in FIG. 10 may be achieved via use of a single travel limiter 905*d*, in some aspects of the present invention, the set of travel limiters may be up to or greater than the number of corresponding chambers 110 of the camshaft variable timing mechanism 100. For example, the aspects of the invention as shown in FIG. 10 may include five travel limiters 905*a*-905*e*, corresponding to those shown in FIGS. 9A-9D. As depicted in FIG. 10, an annular plate 906, or similar securing device, may optionally be abuttedly fixed with respect to the sprocket to enclose the chambers 110 and secure the travel limiter(s) in subchamber(s) 110*a* and/or 110*b*.

Figure 9A:
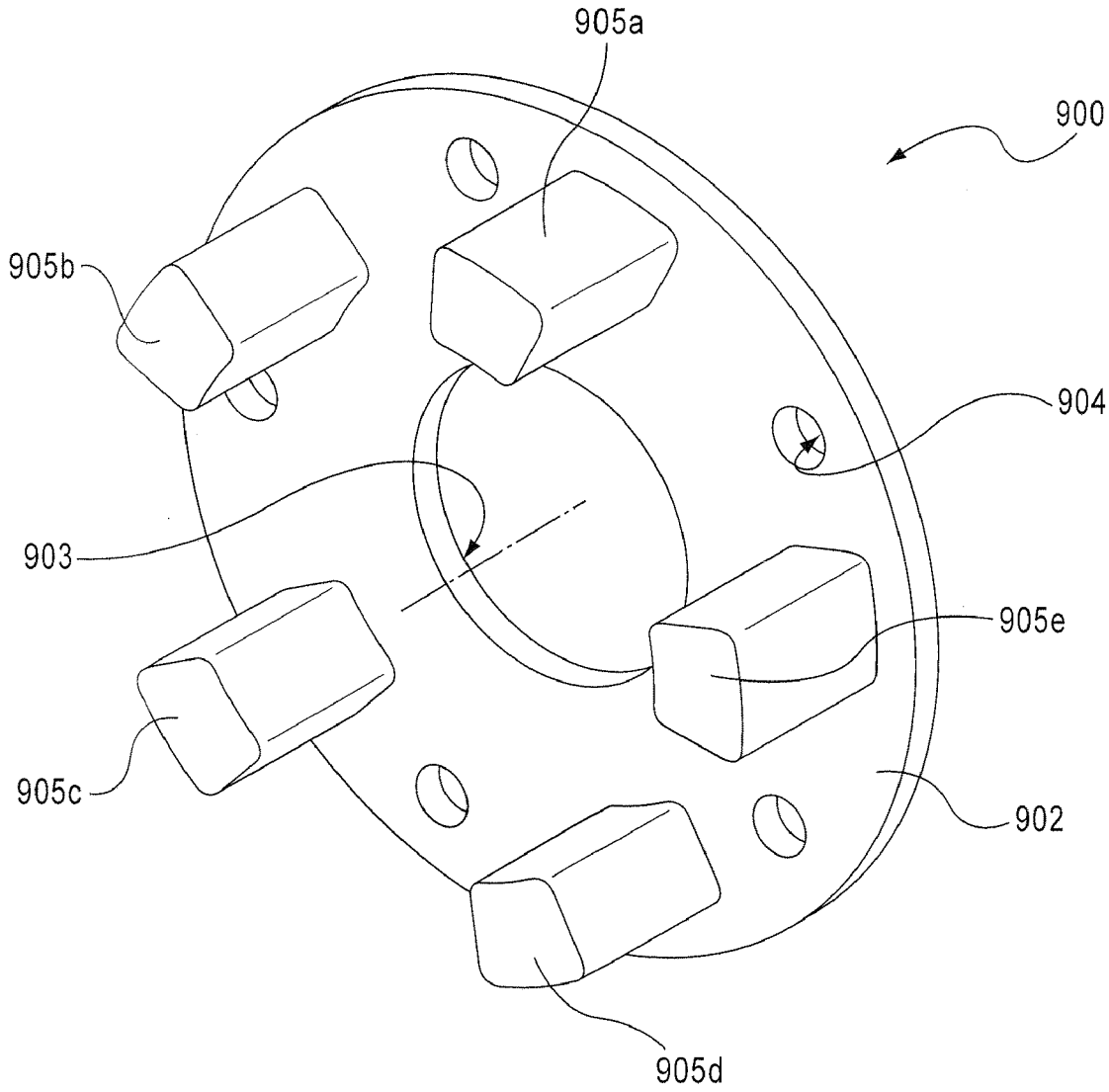
FIGS. 9A-9D present perspective, two opposite end, and side views, respectively, of an exemplary device in accordance with aspects of the present invention for limiting travel of vane lobes of the camshaft variable timing mechanism of FIGS. 1-6.
Figure 9B:
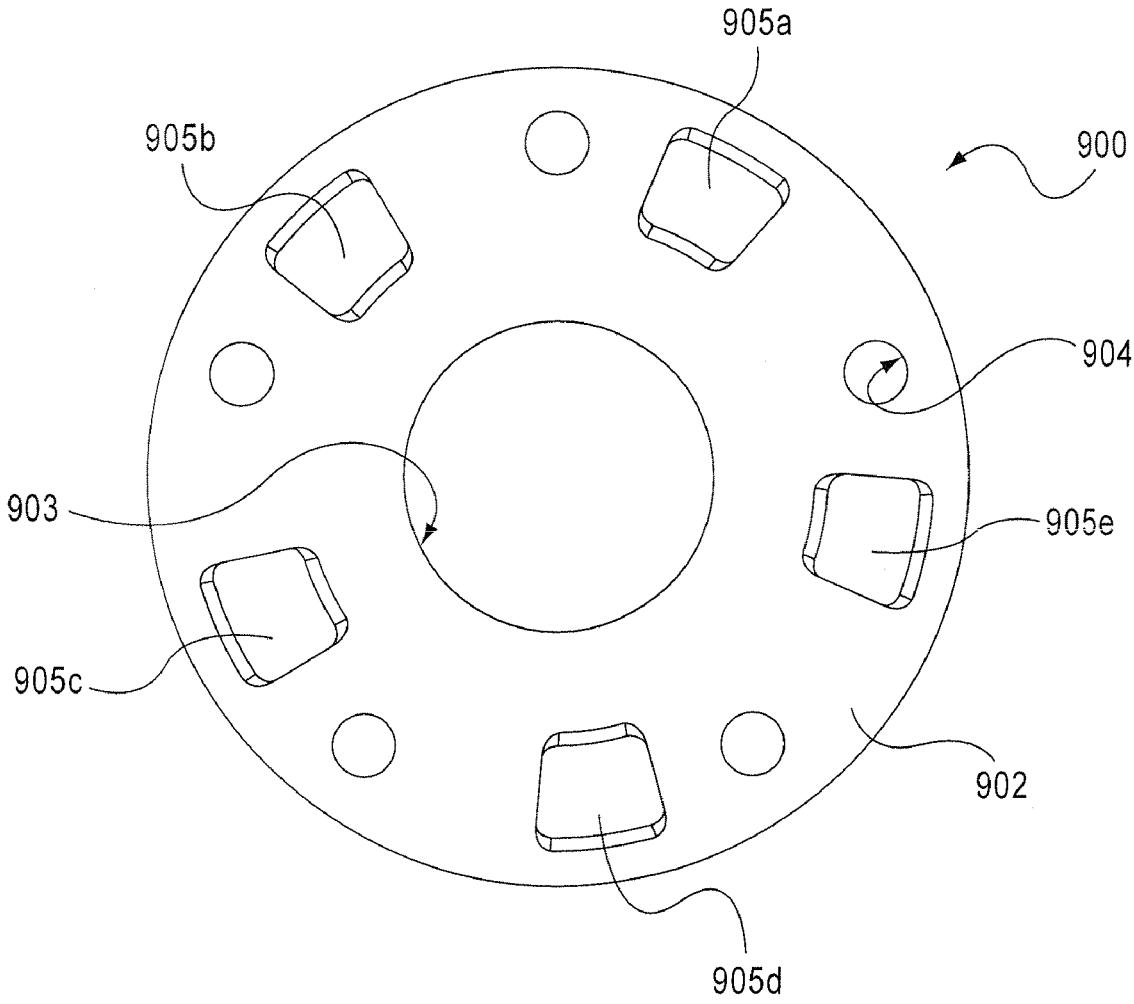
Figure 9D:
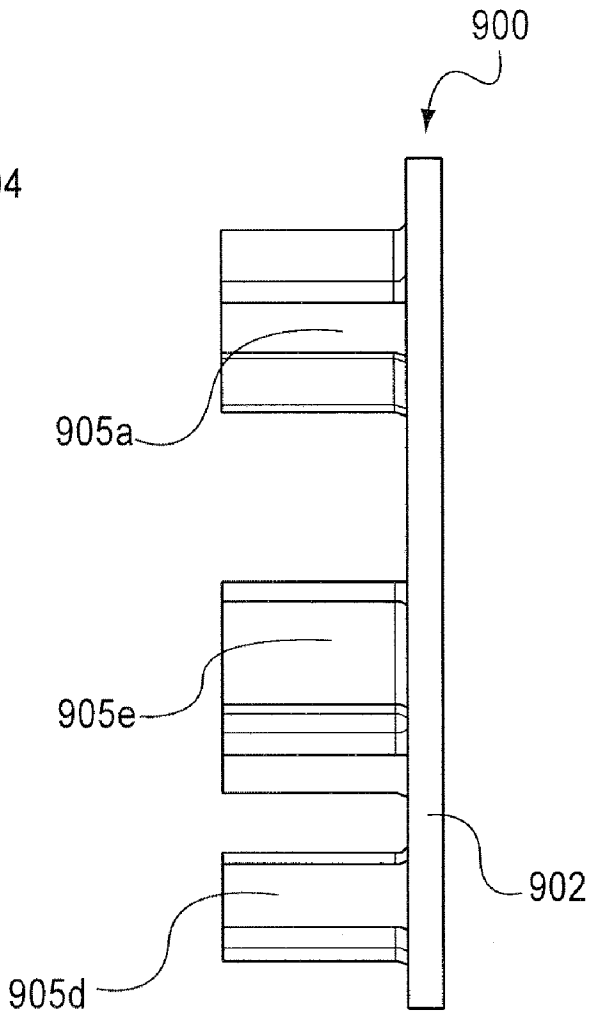
Figure 9C:
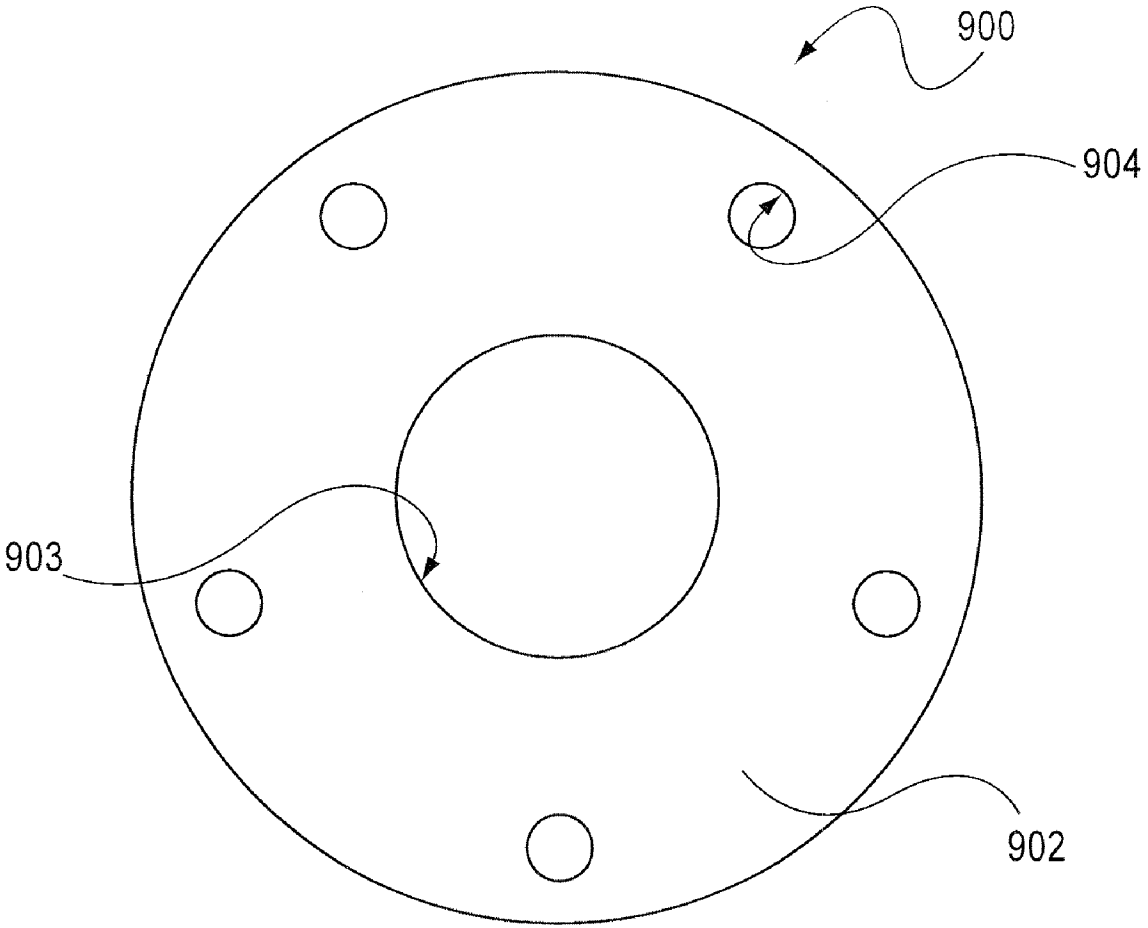

The set of travel limiters of some aspects of the present invention shown in FIGS. 9A-10 may, for example, when positioned relative to the chambers of the camshaft variable timing mechanism, be designed so as to limit travel of the hub relative to the sprocket or other driven portion in a single rotational direction (e.g., only to limit advance or retard). In other aspects of the present invention, a first subset of the set of travel limiters (e.g., three of the five travel limiters) may be positioned so as to limit such relative rotational travel in a first direction (e.g., to limit camshaft advance), and a second subset of the set of travel limiters (e.g., two of the five travel limiters) may be positioned so as to limit such relative rotational travel in a second direction (e.g., to limit camshaft retard).

Figure 11:
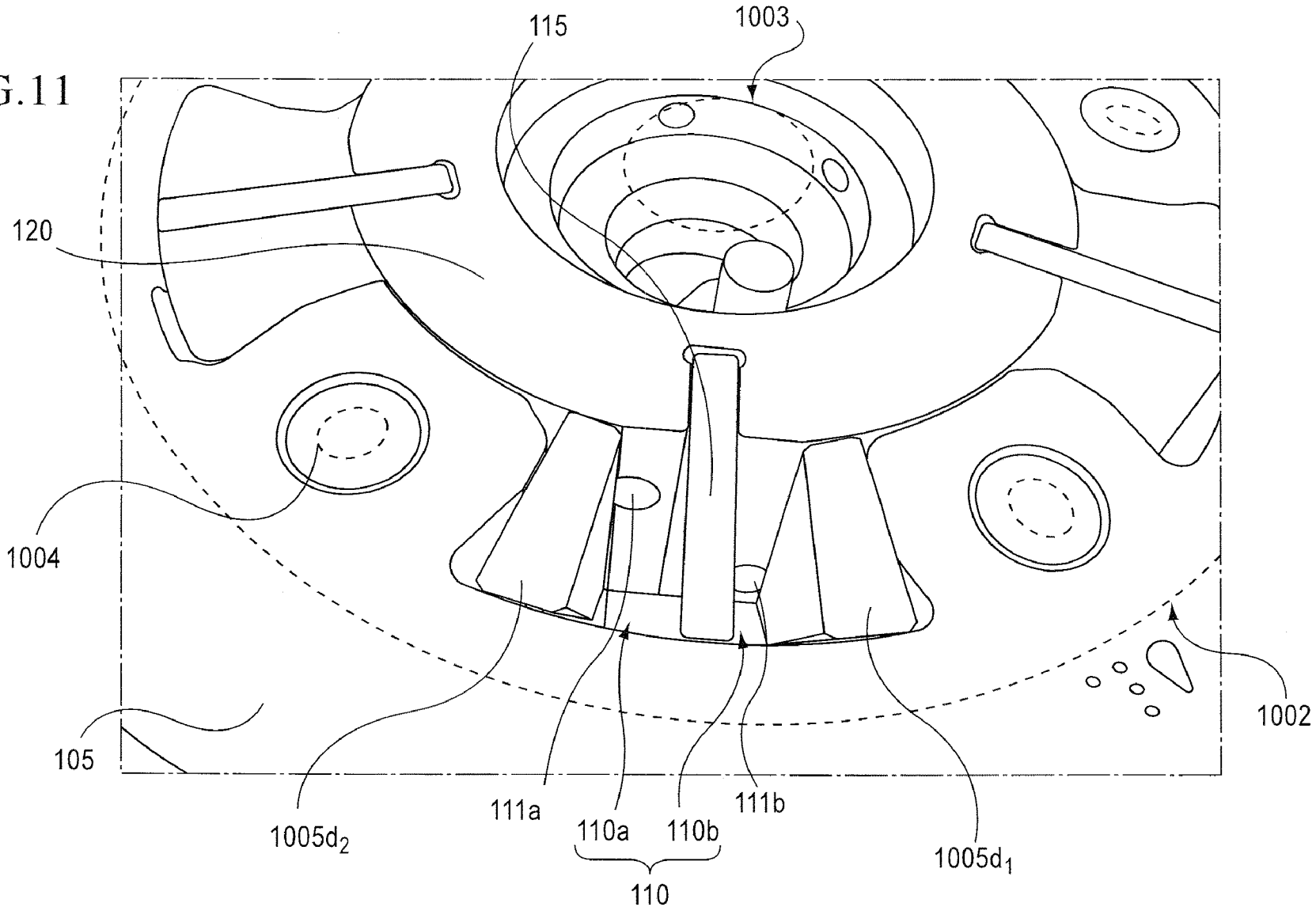
FIG. 11 shows yet other aspects of the present invention, for a device similar to the device FIGS. 9A-9D, but designed so as to provide two travel limiters inserted into two chamber portions of a camshaft variable timing mechanism.

FIG. 11 shows yet other aspects of the present invention, for a device similar to the device 900 of FIGS. 9A-9D, but designed so as to provide two travel limiters 1005$d_1$, 1005$d_2$ inserted into two chamber portions 110*a*, 110*b* comprising a chamber 110. Via use of two such travel limiters 1005$d_1$, 1005$d_2$, relative rotational travel in both a first direction (e.g., to limit camshaft advance) and a second direction (e.g., to limit camshaft retard), may thereby be obtained. Similarly to as described with regard to FIG. 10, a set of pairs of such travel limiters 1005$d_1$, 1005$d_2$ may be provided for insertion into between one and all of the chamber portions in the camshaft variable timing mechanism.

Figure 12A:
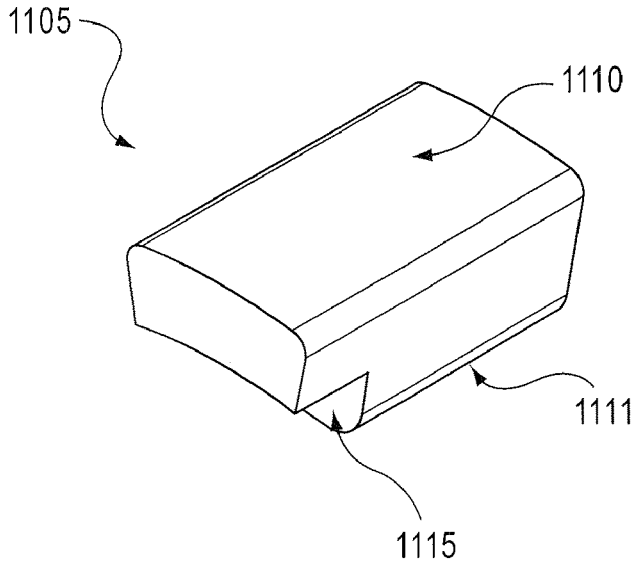
FIGS. 12A-12C show an example travel limiter for positioning in the chamber portion of a camshaft variable timing mechanism.
Figure 12B:
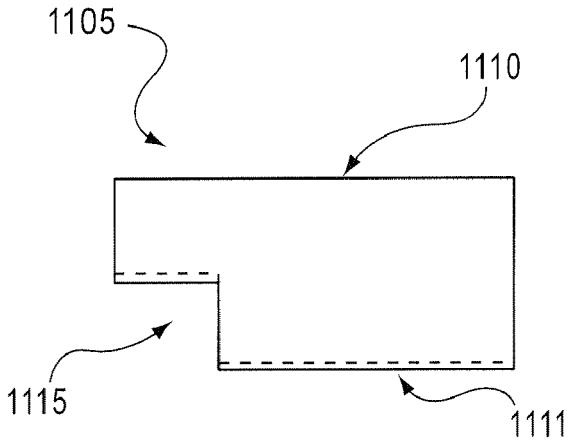
Figure 12C:
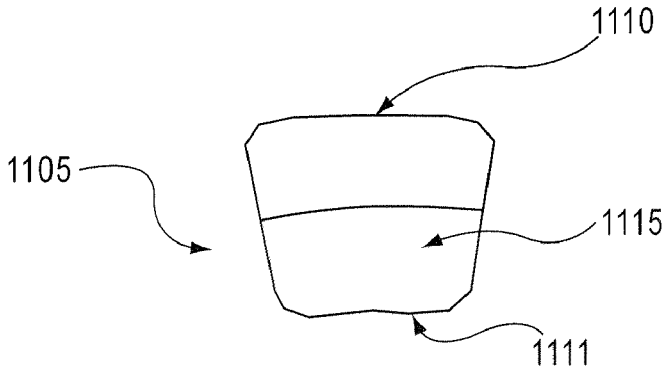

FIGS. 12A-12C show an example of a travel limiter for insertion into a chamber portion of a camshaft variable timing mechanism. The travel limiter 1105 may include an outer peripheral surface 1110 and an inner peripheral surface 1111. The outer peripheral surface 1110 and the inner peripheral surface 1111 may be designed to abut an inner peripheral surface of a sprocket and an outer peripheral surface of a hub, respectively, when the travel limiter 1105 is inserted in a chamber portion of a camshaft variable timing mechanism (see e.g., FIGS. 10 and 11). The travel limiter 1105 may be configured to include a recessed portion 1115, for example, such that the limiter 1105 does not substantially interfere with operation of any hydraulic inlets (see e.g., 111*a* or 111*b* in FIG. 10) when placed into a chamber portion of a camshaft variable timing mechanism. Although described with a recessed portion and depicted as shown in FIGS. 12A-12C, the travel limiter may be configured to be of any shape or geometric dimensions so that the travel limiter may be received into the chamber portion of the camshaft variable timing mechanism without interfering with the hydraulic performance of the camshaft variable timing mechanism.

Example aspects of the present invention have now been described in accordance with the above advantages. It will be appreciated that these examples are merely illustrative of the invention. Many variations and modifications will be apparent to those skilled in the art.

What is claimed is:

1. A variable timing limiting device for a camshaft variable timing mechanism having a motion range for varying timing, comprising: a travel limiter, wherein the camshaft variable timing mechanism comprises a hub and a sprocket matably forming a chamber portion, wherein the travel limiter is located within the chamber portion and configured to provide a first unrestricted motion range portion and a second blocked motion range portion for the camshaft variable timing mechanism, and wherein the travel limiter moves freely within the chamber portion in relation to the hub and sprocket.

2. The variable timing limiting device of claim 1, wherein the camshaft variable timing mechanism further comprises an annular plate that encloses the travel limiter in the chamber portion.

3. The variable timing limiting device of claim 1, wherein the variable timing limiting device comprises a plurality of travel limiters.

4. The variable timing limiting device of claim 1, wherein the travel limiter is configured to limit camshaft advance.

5. The variable timing limiting device of claim 1, wherein the travel limiter is configured to limit camshaft retard.

6. The variable timing limiting device of claim 3, wherein at least one travel limiter is configured to limit camshaft advance and wherein at least one travel limiter is configured to limit camshaft retard.

7. The variable timing limiting device of claim 1, wherein the camshaft variable timing mechanism further comprises a hydraulic inlet in communication with the chamber portion, and wherein the travel limiter comprises a recessed portion configured to allow operation of the hydraulic inlet when the travel limiter is place into the chamber portion of the camshaft variable timing mechanism.

8. A camshaft variable timing mechanism for securing to a camshaft, comprising:

a hub connected to an end of the camshaft;

a vane lobe extending from the hub;

a sprocket portion comprising at least one recess configured to receive an end of the vane lobe, the vane lobe being capable of travel within the recess; and a variable timing limiting device comprising a free floating travel limiter located in the recesses of the sprocket portion for limiting travel of the hub via the vane lobe relative to the sprocket portion.

9. The camshaft variable timing mechanism of claim 8, wherein the camshaft variable timing mechanism further comprises a hydraulic inlet in communication with the recess for pumping hydraulic fluid into the recess to produce movement of the vane lobe, and wherein the travel limiter comprises a recessed portion configured to allow operation of the hydraulic inlet when the travel limiter is placed into the recess of the sprocket portion.

10. The camshaft variable timing mechanism of claim 8, wherein the travel limiter is configured to limit camshaft advance.

11. The camshaft variable timing mechanism of claim 8, wherein the travel limiter is configured to limit camshaft retard.

12. The camshaft variable timing mechanism of claim 8, wherein the variable timing limiting device comprises multiple travel limiters, wherein at least one travel limiter is configured to limit camshaft advance and wherein at least one travel limiter is configured to limit camshaft retard.

13. The camshaft variable timing mechanism of claim 8, wherein the at least one recess comprises a plurality of subchambers and wherein a plurality of travel limiter are located in the plurality of subchambers for limiting travel of the hub via the vane lobe relative to the sprocket portion in two rotational directions.

14. The camshaft variable timing mechanism of claim 8, wherein the camshaft variable timing mechanism further comprises an annular plate engageadly coupled with the sprocket portion for securing the travel limiter.

15. A method of assembling a camshaft variable timing mechanism, comprising:

securing a hub to an end of a camshaft, wherein the hub comprises a vane lobe; and engaging the hub with a sprocket portion engaged with a variable limiting timing device, wherein the sprocket portion comprises a recess which receives an end of the vane lobe, the vane lobe being capable of travel within the recess, and wherein the variable limiter timing device comprises a free floating travel limiter, the travel limiter being located in the recess of the sprocket portion for limiting travel of the hub via the vane lobe relative to the sprocket portion.

16. The method of assembling a camshaft variable timing mechanism of claim 15, further comprising providing hydraulic fluid into the recess through a hydraulic inlet to produce movement of the vane lobe.

17. A method for limiting travel of a vane lobe in a camshaft variable timing mechanism, comprising:

securing a hub to an end of the camshaft, wherein the vane lobe extends from the hub; and engaging the hub with a sprocket portion, wherein the sprocket portion comprises a recess which receives an end of the vane lobe, the vane lobe being capable of travel within the recess;

wherein engaging the hub with a sprocket portion includes positioning a free floating travel limiter in to recess of the sprocket portion and wherein contact of the vane lobe with the travel limiter limits travel of the hub relative to the sprocket portion.

18. The method for limiting travel of a vane lobe in a camshaft variable timing mechanism of claim 17, wherein the recess of the sprocket portion comprises a plurality of subchambers and wherein a plurality of free floating travel limiters are position in the plurality of subchambers for limiting travel of the vane lobe relative to the sprocket portion in two rotational directions.

* * * * *